United States Patent [19]

Green

[11] Patent Number: 4,705,561

[45] Date of Patent: Nov. 10, 1987

[54] MAGNESIUM CALCIUM OXIDE COMPOSITE

[75] Inventor: William G. Green, Freeport, Tex.

[73] Assignee: The Dow Chemical Company

[21] Appl. No.: 822,459

[22] Filed: Jan. 27, 1986

[51] Int. Cl.[4] ..... C21C 7/02

[52] U.S. Cl. ..... 75/58; 75/53

[58] Field of Search ..... 75/53, 58, 130

[56] References Cited

U.S. PATENT DOCUMENTS 4,137,072 1/1979 Kawakami ..... 75/58
4,139,369 2/1979 Kaudler ..... 75/58
4,182,626 1/1980 Strauss ..... 75/58
4,209,325 6/1980 Cooper ..... 75/58

*Primary Examiner*—Peter D. Rosenberg

[57] ABSTRACT

A product and method of manufacture are set forth. The product is used in desulfurizing steel. Magnesium is in its molten state, and with vigorous stirring, lime is added. A relatively brittle material is obtained upon cooling which can be ground to a particulate form and used in steel desulfurization. The composite is both a mixture of magnesium and lime and also includes $Mg_2Ca$ alloy.

13 Claims, No Drawings

MAGNESIUM CALCIUM OXIDE COMPOSITE

BACKGROUND OF THE DISCLOSURE

This disclosure is directed to a magnesium calcium oxide composite which is adapted for use, e.g., in desulfurizing steel manufacturing processes. In addition, nodules in molten ferrous metal are altered in shape to improve workability of metal products. Generally, it is undesirable to incorporate sulfur in steel. This material provides an additive which is injected into the steel manufacturing process to remove sulfur. Injectables are added during steel manufacturing through injection lances. Some mangnesium based injectable materials are salt coated. This coating leads to problems with injection line plugging because of hygroscopic nature of the salt coating material. As the injectable material is introduced into the steel, there is a possibility of violent reaction. For instance, the addition of magnesium in particulate form runs the risk of violent reaction. The violent reaction may take the form of bubbling, splattering, or the like. Moreover, finely ground particulate dust is difficult to meter in blast furnace injection processes. A related factor is that finely ground dust injectables create a hazard in handling. If they are finely ground, exposed to high temperatures and have some supply of oxygen available, there is the possibility of explosion. The material (with low carbon or with high carbon), normally molten at temperatures between 1200° and 1800° C.

Another important problem relates to reduction of nodule size. In a molten ferrous metal, graphite forms slivers which may degrade physical characteristics during metal working. The injectable of this disclosure reduces nodule size by changing nodule shape, reducing nodule surface size and forming nodules of spherical shape. Thus, one feature of the injectable is that it operates to nodulariaze the molten ferrous metal.

The injectable of this disclosure is one that can be added to a steel manufacturing process with reduced risk of explosion, reduced dust problems, reduced segregation of Mg and lime, and yet obtain a high degree of sulfur removal. One reference of interest is U.S. Pat. No. 4,139,369. This is a powder mixture of magnesium and selected calcium compounds. No particular method of preparation is set forth. A similar reference is U.S. Pat. No. 4,182,626. This disclosure mentions a method of manufacture in multiple stages to reduce ignition of the magnesium in powder form. Perhaps a more remote reference is U.S. Pat. No. 4,209,325 which is directed to a similar mixture of magnesium, sintered lime and a fluxing agent. Preferred fluxing agents are alumina or selected fluorides. A mixture of magnesium and calcium oxide is set forth in U.S. Pat. No. 4,137,072. This disclosure appears to be directed solely to a mixture and does not reference magnesium-calcium alloys in conjunction with the mixture of magnesium and calcium oxide. Mixtures of Mg powder and lime powder are likely to segreate into Mg-rich and limerich portions during handling and shipping, in contrast to the compositionally-stable mixtures made in accordance with the present invention.

In contrast with these references, this disclosure describes both the product and the method of manufacture thereof. Briefly, the product is a composite of magnesium and calcium oxide, sometimes called lime. As the references above mentioned note, magnesium and various calcium compounds are known steel desulfurizing agents. As the references above also mention, magnesium is rather unstable in finely ground form and various calcium compounds in powder form are relatively inefficient in use or cost. In contrast, the composite of the present disclosure is both a mixture and an alloy. The composite is therefore somewhat brittle and easily ground to powder form without the dust problems of the prior art. Even when in powdered form, the particles are harder to ignite and therefore more easily stored and handled. At the time of injection, there is less violent reaction in the steel. Moreover, the composite of this invention is a highly desirable injection agent substantially free of the problems of hygroscopic water adsorption, potential dust explosions, and the like. Moreover, it seems to be more desirable in that there is an alloy of magnesium and calcium which lends itself readily to steel desulfurization. By contrast, pure magnesium is difficult to grind while this product is easily broken to pieces and processed to size.

Briefly, the process contemplates utilizing magnesium in a molten state, stirring vigorously while introducing lime into the melt, all accomplished under an inert gas layer to thereby form the composite mixture. On cooling, it can be broken and then ground yielding both a mixture of magnesium with calcium oxide and also magnesium and calcium in an alloy.

DETAILED DESCRIPTIONS INCLUDING THE PREFERRED EMBODIMENTS

The composite of magnesium and lime is formed in the following manner. A suitable quantity of magnesium is heated in a suitable vessel, e.g., a ladle. If available, preheated magnesium can be used as might occur in a smelter. It can be heated to a molten state at about 651° C. or more. There is a risk of fire on exposure to oxygen in the atmosphere. Accordingly, a layer of substantially inert gas is kept over the ladle to reduce the chance of fire. Suitable gases include $CO_2$, $SF_6$, and the like. This suppresses the risk of fire by removing oxygen and nitrogen from the atmosphere around the vessel or ladle. Pure Mg melts at about 651° C. and most Mg alloys melt somewhat lower than that. The temperature range is from a low of 651° C. to a high of about 850° C. While the vessel contents can be heated to higher temperatures, the desirable alloying occurs at 651° C. and higher. The magnesium in a molten form (heated to some temperature) is gas protected. In a separate container, an approximately equal charge by weight of lime is heated. The lime is not heated to the molten state because such heating is not needed. Preheating typically carries the lime up to about 700° C. Again, the lime can be preheated to a wide range of temperatures. Alternatively, the lime can be added at room temperature. It would appear that digestion of the lime into the molten magnesium is more readily accomplished with a measure of preheating. This is not to say that preheating is absolutely essential, but it is desirable. Preferably, of course, substantially all water is removed from the lime before addition to the molten magnesium.

Lime in finely ground form has air in it when handled in bulk. This reduces the density compared to bulk CaO. Finely divided lime floats due to the surface tension of molten magnesium, a factor making it difficult to introduce the lime beneath the surface of the molten magnesium. Large dense particles are not preferred because they may retard the reaction. The lime is thus ground to powder and introduced to the molten magnesium with vigorous stirring. The stirring typically must be sufficient to sustain a vortex in the ladle or vessel to be able to draw the lime under the surface. In one instance, a mixing blade extending into the melt was used. The tip of the mixing blade was rotated to obtain a velocity of about 10,500 inches per second (about 250 meters/sec) tip speed to create the vortex. It will be understood that other kinds of agitation devices can be used. In general terms, the goal is to introduce the particulate lime in a fashion where it is drawn beneath the surface to thereby enable dispersing within the magnesium. The molten metal surface tension must be overcome. In general terms, the heating continues until all of the lime has been introduced into the ladle and has been stirred underneath the surface.

In considering the ratio of lime to magnesium, it has been discovered as little as 350 ppm of lime does reduce combustion of the composite. Brittleness, however, is caused by increasing the quantity of lime. When the lime reaches about 0.1 to about 0.3% by weight, brittleness begins to increase. In making injectables, brittleness is desirable for easier grinding and handling. Thus, the lime added to the magnesium can range from anywhere from 0.01%, even as high as 55% or more. The preferred range of lime is between 45 and 50% by weight of the composite when making injectables. A lime content of 0.01% to 0.1%, especially about 0.03% to about 0.05% is useful in making Mg castings.

The magnesium need not be pure magnesium. Magnesium is also available as an alloy. Two acceptable alloys are AZ91B and AZ91C. While it is substantially magnesium, the AZ91B includes between about 8.3 and about 9.7% by weight aluminum, between about 0.35 to about 1.0% zinc, at least a minimum of manganese exceeding 0.013% and beryllium in trace quantities. Typically, the beryllium is in the range of about 4 to 10 ppm. By contrast, AZ91C is similar, but excludes the beryllium. Suffice it to say, the magnesium stock can be very pure or an alloy commercially available. If an alloy is used, the trace elements generally do not prevent proper alloying with the CaO.

In generaly terms, increasing the lime above the level of about 350 ppm not only reduces combustability of the composite but also increases the brittleness. If the lime is increased to about 50% and the magnesium (pure or from an alloy) is the remaining 50% of the ingredients, the resulting product is quite brittle. It is a composite. On suitable laboratory analysis, it yields a composite which is sufficiently brittle that it is able to be easily broken and ground to a particulate form. The size of the particles can be controlled by the degree of grinding. Typically, the particles should be in the range of about 30 to 60 mesh, U.S. Standard Mesh. Alternatively, it can be ground in a conventional grinding mill to obtain a specified surface area of square meters per gram. If there are relatively large pieces in the ground product, they are not viewed with alarm because they are still consumed in the desulfurization process. Large particles may require a longer time for ultimate consumption.

The preferred process involves stirring in the vessel and then pouring into a mold of any suitable shape. The mold is preheated for drying. The molten mass is primarily magnesium having the stirred lime in it. It may be heated (before pouring) to any temperature sufficient to maintain a molten state. On pouring, stirring stops and rapid cooling carries the poured material toward solidification. As the thoroughly stirred mass cools, there is an alloy precipitation process. As reported in *Constitution of Binary Alloys*, Hansen, Second Edition, 1958, McGraw-Hill, the precipitant is $Mg_2Ca$ which precipitates in the molten mass. Remaining materials form a composite or mixture and thereby account for the furnished ingredients. This composite (including the portion which did not alloy) will also solidify to enable grinding of the entire mass.

In general terms, the product after heating and solidification is a composite of magnesium and lime with the precipitant alloy. The $Mg_2Ca$ appears to consume a signifcant portion of added lime. It would appear that the compounding process involves a reaction with the lime, but does not necessarily go to completion, meaning consumption of all the lime. Depending on the degree of stirring, temperature of the mixture, and other factors, the reaction consumes up to about 45% of the calcium (by weight) in the $Mg_2Ca$ alloy. Remaining metallic feed is a composite as will be described. All of the melted material cools to solidify and is available for grinding.

Consider one example of the manufacture of this composite taught by this disclosure. In a ladle beneath a suitable inert gas atmosphere, approximately 10 kilograms of magnesium was heated to a molten state was obtained. The average temperature in the ladle was in the range of about 690° C. An approximate equal weight of lime was heated in a separate vessel to about 700° C. Through the use of a stirring device, stirring was vigorously undertaken with the tip speeds mentioned above to form a vortex in the molten magnesium. Approximately 10 kilograms of lime was then introduced over a period of about 5 minutes. Care was taken to be sure that the freshly introduced lime was folded under the surface of the molten magnesium. After the addition, mixing was continued for up to about 30 minutes. The temperature was checked to be sure it was under 715° C. The mixing was then terminated, and the contents of the ladle were then poured into a mold and cooled to a hardened state. When cool, the contents were broken out to yield a brittle material. This composite material was then ground. Suitable testing by various analytical techniques showed that about 45% of the lime was alloyed to form $Mg_2Ca$. The alloy was mixed with lime and magnesium in the cooled material. This yielded a particulate product suitable for steel manufacturing, namely the reduction of sulfur in ferrous metal processing.

A reversible reaction which occurs from the addition of lime to mangesium involves the following chemical reaction: $Mg + CaO \rightleftharpoons MgO + Ca$ This reaction is a reversible equation. Indeed, there is a preference to proceed to the left so that the original feed materials are obtained. This reversible situation makes it difficult to obtain any alloy. The alloy $Mg_2Ca$ is obtained as a precipitant as the molten material is cooled. Thus, the lime is added to the molten magnesium at temperatures sufficient to submerge the lime below the surface. Within the molten mass, the constituents undergo the reversible reaction written above. It appears that when the present reaction is done at a temperature between about the melting point of the Mg metal (or Mg alloy) and about 715° C., the $Mg_2Ca$ forms as a dispersed solid, thereby driving the reaction to the right until about 45% of the CaO has been converted to $Mg_2Ca$. However, when the reaction is done about above 715° C. the $Mg_2Ca$ forms in solution and the reaction reaches equilibrium when about 5% of the CaO has been converted to $Mg_2Ca$. As the temperature of the material is cooled towards to 715° C., the precipitant is formed, namely solidifying to remove the alloy $Mg_2Ca$ from further reaction. Because it is removed, this reduces substantially the available constituent material in the vessel. This precipitation breaks the reversible reaction when a significant portion of the material is removed. The alloy $Mg_2Ca$ is about 45 weight % calcium. Even if all of the materials in the vessel are not converted to this desirable alloy, those which remain are still useful. That is, they can be used in the desulfurization process. Moreover, those materials which are in the mold upon cooling, whether or not $Mg_2Ca$, can be easily ground and provide the same benefits in desulfurization. For that reason, total conversion of the feed to $Mg_2Ca$ alloy is not essential; it is desirable therefore to cool the material so that a substantial portion of the materials is converted into this desirable alloy. This conversion of calcium into the desirable alloy suggests a preferred ratio of 45 weight % calcium, and provision of up to about 50% lime in the feed is certainly acceptable. Recall that the feed is lime, not pure calcium; the preferred range of lime is about 45 to about 60% by weight of the ingredients furnished for manufacture of the desirable injectable material obtained by the present process. For Mg castings, a CaO content of less than 0.1% should be used.

The temperature of the mixed composite material during manufacture changes the relative ratio somewhat. The typical range extends from a low temperature of 651° C. necessary to melt magnesium up to about 850° C., a maximum economically determined to avoid waste of heat energy. There is a mid point at about 715° C., or perhaps a mid range of 705° C. to 725° C. There is another important temperature derived from the reference text, namely 715° C. at which $Mg_2Ca$ alloy precipitates in solution.

In general, heating the mix to a temperature in the range above the magnesium melting temperature of 651° C. and up to the mid range yields a mixture having more calcium, more magnesium oxide, less magnesium and less calcium oxide. The mixture, having more calcium, is very desirable as a desulfurizing agent. The mixture has reduced nodularizing impact compared with the mixture heated to the following temperature range.

A second range extend from the mid range to the maximum. The mixture in this range has increased nodularizing impact. The higher temperature range yields a mixture having relatively more magnesium, less calcium and more calcium oxide.

Even though the two described temperature ranges change the mixture somewhat, it cannot be said that the mixture made at either temperature range is devoid of efficacy when used for the less favored need. That is, the mixture made by low temperature heating still has signifcant potency for nodularizing molten ferrous metals.

Regarding the mid range, it is a range, about 705° C. to 725° C. It is a range, and is not a definitive data point. Thus, a mixture heated to this temperature range will yield a product having both significant desulfurizing and nodularizing activity. Recalling that $Mg_2Ca$ forms a precipitant at 715° C., this binds available Mg and Ca. If the temperature is over 715° C., cooling to 715° C. creates a precipitant in the vessel. In the event the mixture is heated to some level less than 715° C., the alloy process still occurs but the alloying is not accompanied by precipitation. Rather, the alloy will be made, remaining in the mixture even though in suspension. At temperatures below 715° C., the alloying process proceeds, removing available Mg and Ca to form alloy and thereby reduce available element supply. In other words, alloying to form $Mg_2Ca$ occurs at temperatures over a range; however, if the mixture is heated above 715° C. and then cooled, a precipitant is formed in the vessel. This process thus forms an alloy in the heating vessel, the alloy being mixed with the other elements or oxides to define an injectable for use with molten ferrous metals.

In general terms, the two ingredients can be supplied at any ratio of up to about 60% lime. The $Mg_2Ca$ alloy removes a fixed ratio of Mg and Ca; the total amount of Mg and Ca being dependent on the intimacy of mixture, temperature and factors relating to the mixing in the vessel as the alloy is formed. As stated earlier, the two feed materials can be varied at any ratio, but 60% lime is a practical upper limit.

In general terms, the product obtained by this method of manufacture does not particularly absorb substantial quantities of water. It can then be injected after grinding to the particulate form, the injection typically involving injection through an injection tube or lance into a vessel during steel manufacture. The mode of injection varies widely.

The lime is not required to be totally pure. However, relatively pure lime is available at reasonable cost, the purity typically being in excess of about 98%. The magnesium used in the present process is optionally pure magnesium although many magnesium alloys can be used. Those alloys which are most desirable are the ones which incorporate traces of aluminum, manganese, and perhaps other typical alloying agents.

While the foregoing is directed to the preferred embodiment, the scope is determined by the claims which follow.

What is claimed is:

1. A method of manufacture of an injectable for molten ferrous metal comprising the steps of:
   (a) obtaining a specified weight of magnesium in a molten state;
   (b) adding calcium oxide to the magnesium accompanied with mixing and continuing until sufficent calcium oxide has been added that a specified ratio between magnesium and calcium oxide has been achieved and mixing in the molten magnesium has occurred;
   (c) cooling the mixture to solidify the mixture; and
   (d) crushing the cooled mixture to particulate form for subsequent injection into molten metal.

2. The method of claim 1 further including the step of elevating the temperature of the magnesium to above 651° C. beneath an atmosphere excluding oxygen and nitrogen sufficiently to prevent burning of the magnesium, and wherein the portion of calcium oxide added is up to about 60% by weight.

3. The method of claim 2 wherein the particulate form is in a range of 30 to 60 mesh U.S. Standard Mesh.

4. The method of claim 1 including the preliminary step of preheating in a separate container calcium oxide to an elevated temperature appoximating that of the molten magnesium.

5. The method of claim 1 wherein the magnesium is heated to a molten state at a temperature above about 715° C. and then cooled to a temperature to form a precipitant alloy $Mg_2Ca$.

6. The method of claim 5 wherein the temperature is less than about 850° C.

7. The method of claim 1 including the steps of:

(a) mixing the CaO at temperature above ambient in particulate anhydrous form;

(b) mixing CaO into a stirred vortex in molten magnesium; and (c) cooling the molten magnesium to a temperature below 715° C. to form $Mg_2Ca$ precipitant and then cooling to solidify.

8. The method of claim 1 wherein:

(a) the magnesium is an alloy predominantly of magnesium; and (b) the mixing of calcium oxide is conducted by agitation of the melted magnesium sufficiently vigorous to force calcium oxide in particulate form into the melted magnesium.

9. A method of preparing a magnesium heated material comprising the steps of:

(a) melting in a container a predominantly magnesium alloy;

(b) distributing particulate calcium oxide through the melted magnesium sufficiently until particulate calcium oxide is dispersed through the melted magnesium; and (c) casting the melted material to a specfied shape by cooling.

10. The method of claim 9 including the step of submerging the calcium oxide below the surface of the melted magnesium.

11. The method of claim 9 wherein the magnesium is melted to a molten state and the calcium oxide is preheated to drive off moisture.

12. The method of claim 9 wherein the product thereof is a mixture including $Mg_2Ca$ alloy.

13. The method of claim 9 wherein the molten mixture of magnesium and calcium oxide is cooled through a temperature of 715° C. to cool and thereby form a $Mg_2Ca$ precipitant.

* * * * *

UNITED STATES PATENT AND TRADEMARK OFFICE

CERTIFICATE OF CORRECTION

PATENT NO. : 4,705,561

DATED : November 10, 1987

INVENTOR(S) : William G. Green

It is certified that error appears in the above-identified patent and that said Letters Patent is hereby corrected as shown below:

Column 1, line 28, "The material" should read -- The injectable can be used in any mixture of molten ferrous material --.

Column 1, line 38, "nodulariaze" should read -- nodularize --

Column 3, line 42, "generaly" should read -- general --.

Signed and Sealed this

Twenty-first Day of June, 1988

*Attest:*

DONALD J. QUIGG

*Attesting Officer*

*Commissioner of Patents and Trademarks*